US008428272B2

(12) United States Patent
Tohyama et al.

(10) Patent No.: US 8,428,272 B2
(45) Date of Patent: Apr. 23, 2013

(54) MASKING SOUND GENERATING APPARATUS, MASKING SYSTEM, MASKING SOUND GENERATING METHOD, AND PROGRAM

(75) Inventors: Mikio Tohyama, Fujisawa (JP); Mai Koike, Anjo (JP); Yasushi Shimizu, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 728 days.

(21) Appl. No.: 12/708,751

(22) Filed: Feb. 19, 2010

(65) Prior Publication Data

US 2010/0208912 A1 Aug. 19, 2010

(30) Foreign Application Priority Data

Feb. 19, 2009 (JP) ..... 2009-036627
Feb. 18, 2010 (JP) ..... 2010-033441

(51) Int. Cl.
*H04R 3/02* (2006.01)

(52) U.S. Cl.
USPC ..... 381/73.1; 704/226

(58) Field of Classification Search ..... 381/316–317, 381/71.1–71.14, 94.1–94.9, 73.1, 61; 700/94; 704/205, 226
See application file for complete search history.

(56) References Cited

U.S. PATENT DOCUMENTS 7,184,952 B2 * 2/2007 Hillis et al. ..... 704/213
7,505,898 B2 * 3/2009 Hillis et al. ..... 704/203
8,050,931 B2 * 11/2011 Ito et al. ..... 704/278
8,271,288 B2 * 9/2012 Ito et al. ..... 704/278
2008/0235008 A1 9/2008 Ito et al.
2008/0243492 A1 * 10/2008 Miki et al. ..... 704/205

FOREIGN PATENT DOCUMENTS

JP 2008-233671 A 10/2008

* cited by examiner

*Primary Examiner* — Vivian Chin
*Assistant Examiner* — Fatimat O Olaniran
(74) *Attorney, Agent, or Firm* — Morrison & Foerster LLP

(57) ABSTRACT

In a masking sound generating apparatus, a band divider divides a target sound signal into a plurality of frequency bands to generate a plurality of band signals. An envelope signal generating part generates a plurality of envelope signals representing respective envelopes of the plurality of the band signals. A signal converter segments each of the plurality of the envelope signals into a plurality of frames, then specifies frames of segmented envelope signals which have an amplitude greater than a first threshold and less than a second threshold, and changes an order of the specified frames in an arrangement of the plurality of the frames. A multiplier multiplies each of the plurality of the envelope signals by a noise signal, each envelope signal having the order of the frames changed by the signal converter, and outputs the plurality of the envelope signals multiplied by the noise signal as individual band masking signals. An adder adds the individual band masking signals to output a masking sound signal capable of masking the target sound signal.

10 Claims, 3 Drawing Sheets

MASKING SOUND GENERATING APPARATUS, MASKING SYSTEM, MASKING SOUND GENERATING METHOD, AND PROGRAM

BACKGROUND OF THE INVENTION

1. Technical Field of the Invention

The present invention relates to a technology for generating a masking sound to prevent an original sound from being overheard.

2. Description of the Related Art

The masking effect is a phenomenon in which, when two types of sound signals having similar frequency component characteristics are propagated in the same space, it is difficult for a listener to identify the sound signals. In one technology, overhearing of spoken sound is prevented using the masking effect. In this technology, a sound signal of a vocal sound generated in a room is collected as a target sound signal and is processed into a masking sound signal having frequency characteristics which do not allow the target sound signal to be perceived as a vocal sound, and the masking sound signal is then emitted outside the room. In this case, it is difficult to hear the target sound signal outside the room due to the masking effect since both the target sound signal and the masking sound signal which has frequency components close to those of the target sound signal are emitted outside the room. Prevention of overhearing using such masking effect is described in Japanese Patent Application Publication No. 2008-233671. In a masking system described in Japanese Patent Application Publication No. 2008-233671, a target sound signal collected through a microphone in one of two adjacent rooms is divided into sections, each corresponding to one syllable, and a scrambling process is performed on the target sound signal such as to rearrange the sections of the sound signal, and the scrambled sound signal is emitted as a masking sound signal through a speaker in the other room.

However, since such a masking system simultaneously emits two types of sound signals, i.e., the target sound signal and the masking sound signal, a listener in the room may perceive noisy or unnatural sound, depending on the relation between the frequency components of the target sound signal and the frequency components of the masking sound signal.

SUMMARY OF THE INVENTION

The invention has been made in view of these circumstances and it is an object of the invention to generate a masking sound, which does not cause perception of noisy or unnatural sound, from a sound collected inside a room.

The invention provides a masking sound generating apparatus comprising: a band dividing part divides an audio signal into a plurality of frequency bands, and generates a plurality of band signals belonging respectively to the plurality of the frequency bands; an envelope signal generating part that generates a plurality of envelope signals representing respective envelopes of the plurality of the band signals generated by the band dividing part; a signal converting part that applies to each of the plurality of the envelope signals generated by the envelope signal generating part a signal conversion process so as to randomize sections of the envelope signal which are greater than a first threshold and less than a second threshold which is greater than the first threshold, and outputs the plurality of the envelope signals each applied with the signal conversion process; a multiplying part that multiplies each envelope signal outputted from the signal converting part by a signal belonging to a frequency band same as that of each envelope signal, and outputs the plurality of the envelope signals multiplied by the signals as individual band masking signals corresponding to the respective frequency bands; and an adding part that adds the individual band masking signals output by the multiplying part and outputs a masking sound signal as a result of the addition.

Here, the plurality of the envelope signals generated from the envelope signal generating part relate to intelligibility of sound represented by the audio signal. In this invention, the signal converting part randomizes the envelope signals so as to partially destroy an order of waveform which the envelope signal possesses (namely, disordering the waveform of the envelope signal), thereby reducing the intelligibility of the masking sound signal. According to the invention, it is possible to generate a masking sound that does not cause perception of noisy or unnatural sound.

DETAILED DESCRIPTION OF THE INVENTION

Embodiments of the invention will now be described with reference to the accompanying drawings.

Figure 1:
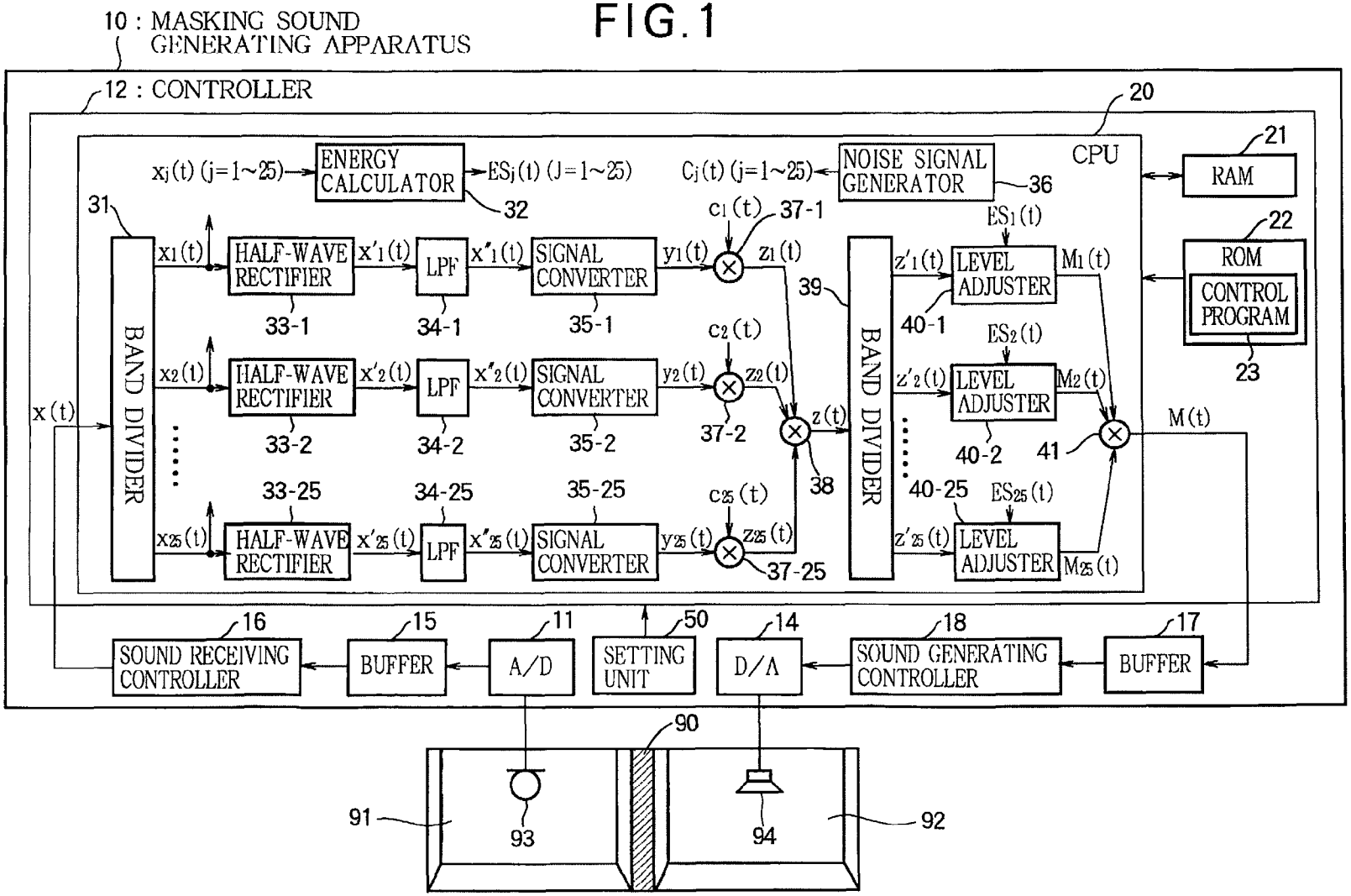
FIG. 1 illustrates a configuration of a masking sound generating apparatus that is an embodiment of the invention.

FIG. 1 is a block diagram illustrating a configuration of a masking system including a microphone 93, a speaker 94, and a masking sound generating apparatus 10 according to an embodiment of the invention. The masking sound generating apparatus 10 generates a different sound signal (which will be referred to as a "masking sound signal M(t)"), which makes it difficult to hear an original sound received in one room 91 among two rooms 91 and 92 divided by a wall 90, from a sound signal (which will be referred to as a "target sound signal x(t)") corresponding to the sound received by the microphone 93 in the room 91 and outputs the generated masking sound signal M(t) to the other room 92 through the speaker 94.

An analog waveform signal of an original sound received by a microphone 93 fixed in the room 91 is input to an A/D converter 11 in the masking sound generating apparatus 10. The A/D converter 11 converts the analog waveform signal into a digital signal and writes the digital signal as a sample sequence of the target sound signal x(t) to a buffer 15. When a trigger to generate a masking sound is issued, a sound receiving controller 16 reads the sample sequence of the target sound signal x(t) from the buffer 15 and outputs the read sample sequence to a controller 12 within a predetermined time T (for example, 2 seconds) from the time when the trigger is issued. The controller 12 generates a masking sound signal M(t) corresponding to the time T (i.e., having a length of the time T) by performing signal processing on the target sound signal x(t) received from the A/D converter 11, and writes a sample sequence of the generated masking sound signal M(t) to a buffer 17. Details of the signal processing performed by the controller 12 will be described later. When the sample sequence of the masking sound signal M(t) is written to the buffer 17, a sound generating controller 18 repeats a process for reading the sample sequence from the buffer 17 and outputting the read sample sequence to a D/A converter 14. The D/A converter 14 converts the sample sequence of the masking sound signal M(t) output from the controller 12 into an analog waveform signal and outputs the analog waveform signal to the speaker 94 fixed in the room 92.

The controller 12 of the masking sound generating apparatus 10 includes a controller 20, a RAM 21, and a ROM 22 which is a machine readable recording medium. The controller 20 executes a control program 23 stored in the ROM 22 using the RAM 21 as a work memory. The control program 23 is a program which causes the controller 20 to implement respective functions of a band divider 31, an energy calculator 32, half-wave rectifiers 33-*j* (j=1~25), Low Pass Filters (LPFs) 34-*j* (j=1~25), signal converters 35-*j* (j=1~25), a noise signal generator 36, multipliers 37-*j* (j=1~25), an adder 38, a band divider 39, level adjusters 40-*j* (j=1~25), and an adder 41.

The band divider 31 divides the target sound signal x(t) provided from the A/D converter 11 into twenty five number of bands by ¼ octave interval and outputs band signals $x_j(t)$ (j=1~25) belonging respectively to both the divided bands to the energy calculator 32 and the half-wave rectifiers 33-*j* (j=1~25).

The energy calculator 32 is a part for calculating respective sound energies from the output signals $x_j(t)$ (j=1~25) of the band divider 31. More specifically, the energy calculator 32 calculates the squares of the amplitudes of the band signals $x_j(t)$ (j=1~25) as sound energies thereof, and writes sample sequences of signals $ES_j(t)$ indicating the sound energies to storage regions AR-$ES_j$ (j=1~25) of the RAM 21. The level adjusters 40-*j* (j=1~25) use the sample sequences of the signals $ES_j(t)$ in the storage regions AR-$ES_j$ (j=1~25) to perform signal level adjustment. Details of this process will be described later.

Each of the half-wave rectifiers 33-*j* (j=1~25) generates a signal $x'_j(t)$ by performing half-wave rectification on a corresponding output signal $x_j(t)$ of the band divider 31 and outputs the signal $x'_j(t)$ to a corresponding LPF 34-*j*. The LPFs 34-*j* (j=1~25) function as envelope signal generation part that generate respective envelope signals $x''_j(t)$ (j=1~25) of a plurality of (for example twenty five) bands indicating respective envelopes of the signals $x'_j(t)$ (j=1~25) of the plurality of bands output from the half-wave rectifiers 33-*j* (j=1~25). More specifically, each of the LPFs 34-*j* (j=1~25) removes components above a cutoff frequency fc (for example, fc=500 Hz) from a corresponding output signal $x'_j(t)$ and outputs the resulting signal as an envelope signal $x''_j(t)$.

Each of the signal converters 35-*j* (j=1~25) applies, to the sample sequence of the envelope signal $x''_j(t)$ corresponding to the time length T outputted from the LPF 34-*j*, a signal conversion process so as to randomize portions or sections of the sample sequence of the envelope signal $x''_j(t)$ which are greater than a first threshold Th1 and less than a second threshold Th2.

Specifically, each of the signal converters 35-*j* (j=1~25) segments a sample sequence of an envelope signal x"j(t) of the time T output from a corresponding LPF 34-*j* into sections which are called frames, each frame having a predetermined interval, and changes the order of arrangement of frames, in which a representative value of the amplitude of the envelope signal x"j(t) is greater than a lower threshold Th1 and less than an upper threshold Th2 (i.e., Th1<representative amplitude value<Th2) among the frames, within the predetermined time T and outputs an envelope signal $y_j(t)$ having the changed order of arrangement of frames. As will be described in detail later, the thresholds Th1 and Th2 are set through a setting unit 50.

Figure 2:
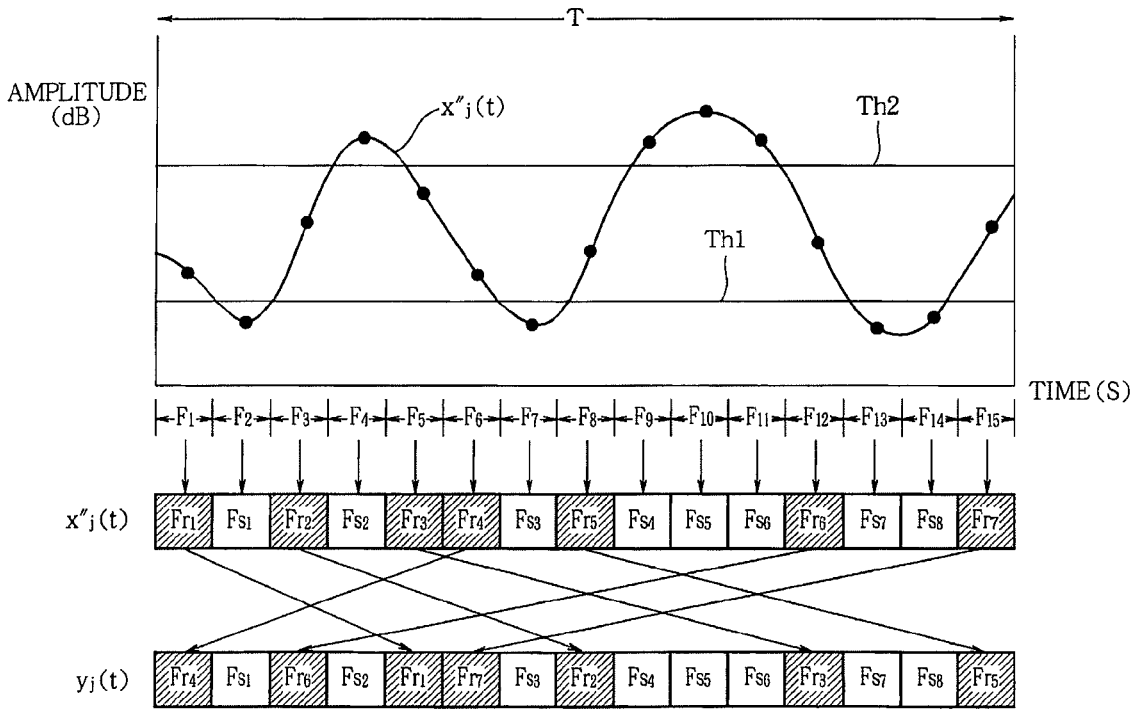
FIG. 2 illustrates details of a process performed by a signal converter in the masking sound generating apparatus shown in FIG. 1.

A procedure performed by each signal converter 35-*j* is described below with reference to an example wherein the LPF 34-*j* outputs an envelope signal $x''_j(t)$ having an undulating (sinusoidal) amplitude as shown in a waveform diagram of FIG. 2 with a horizontal axis representing time (s) and a vertical axis representing amplitude (dB). First, the signal converter 35-*j* segments the sample sequence of the envelope signal $x''_j(t)$ into frames $F_i$ (i=1, 2 . . . ) and determines that the average of the amplitude of the signal $x''_j(t)$ in each frame $F_i$ is a representative value of the amplitude of the signal $x''_j(t)$ in each of the frames $F_i$. Here, it is assumed that the number of frames is fifteen for the sake of convenience. The signal converter 35-*j* then determines that frames $F_2$, $F_4$, $F_7$, $F_9$, $F_{10}$, $F_{11}$, $F_{13}$, and $F_{14}$, in which the amplitude of the signal x"j(t) is less than or equal to the threshold Th1 or is equal to or greater than the threshold Th2, among the frames $F_i$ (i=1~15) are frames $F_{s1}$, $F_{s2}$, $F_{s3}$, $F_{s4}$, $F_{s5}$, $F_{s6}$, $F_{s7}$, and $F_{s8}$ which do not require change of the order of arrangement, and determines that frames $F_1$, $F_3$, $F_5$, $F_6$, $F_8$, $F_{12}$, and $F_{15}$, in which the amplitude of the signal x"j(t) is greater than the threshold Th1 and less than the threshold Th2, among the frames $F_i$ (i=1~15) are frames $F_{r1}$, $F_{r2}$, $F_{r3}$, $F_{r4}$, $F_{r5}$, $F_{r6}$, and $F_{r7}$ which require change of the order of arrangement. The signal converter 35-*j* then randomly changes the order of arrangement of the frames $F_{rl}$ (l=1~7) among the frames of the two groups $F_{rl}$ (l=1~7) and $F_{sm}$ (m=1~8) while keeping the order of arrangement of the frames $F_{sm}$ (m=1~8) unchanged, and outputs a signal with the changed order of arrangement of the frames $F_{rl}$ (l=1~7) as an envelope signal $y_j(t)$. Here, each of the signal converters 35-*j* (j=1~25) changes the order of arrangement of the frames $F_{rl}$ (l=1, 2 . . . ) of a corresponding one of the envelope signals $x''_j(t)$ (j=1~25), for example, using a pseudo-random number generated from an individual seed value so that the correlation between each of the envelope signals $y_j(t)$ (j=1~25) is not high.

In FIG. 1, the noise signal generator 36 generates a Hilbert carrier signal of white noise and divides the Hilbert carrier signal into the same twenty five bands as those into which the band divider 31 divides the target sound signal x(t), and outputs signals belonging respectively to the divided bands as noise signals C (t) (j=1~25) to multipliers 37-*j* (j=1~25). The multipliers 37-*j* (j=1~25) multiply the output signals $y_j(t)$ of the signal converters 35-*j* by the noise signals $C_j(t)$ of the corresponding bands output from the noise signal generator 36, respectively, and then output the multiplied signals as individual band masking signals $z_j(t)$ of the frequency bands.

The adder 38 adds the individual band masking signals $z_j(t)$ (j=1~25) output from the multipliers 37-*j* (j=1~25) and outputs the result of the addition as a composite masking sound signal z(t). The band divider 39 again divides the masking sound signal z(t) output from the adder 38 into the same twenty five frequency bands as those into which the band divider 31 divides the target sound signal x(t), and outputs signals belonging respectively to the divided bands as individual band masking signals $z'_j(t)$ (j=1~25).

Figure 3:
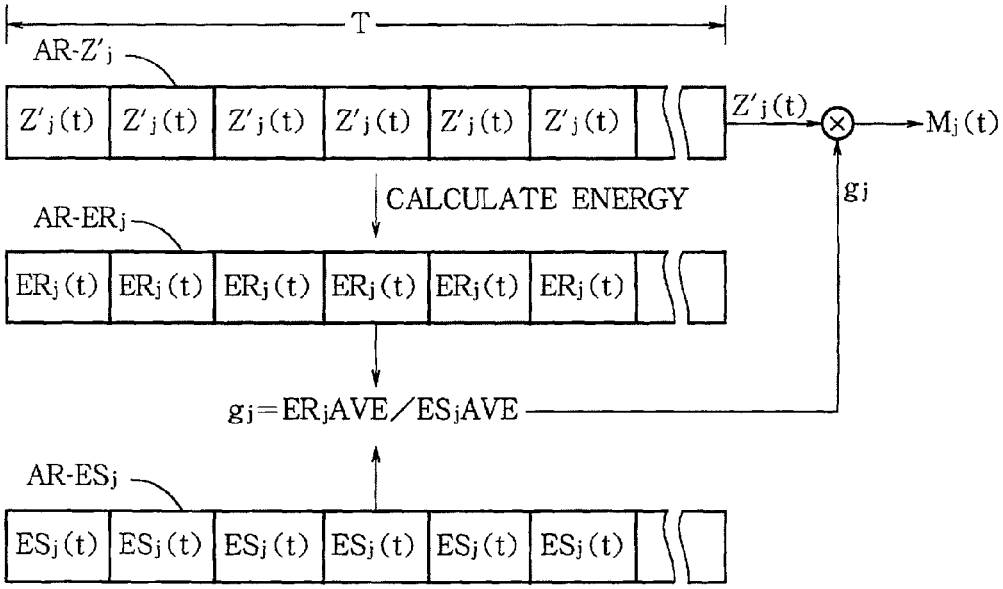
FIG. 3 illustrates details of a process performed by a level adjuster in the masking sound generating apparatus shown in FIG. 1.

The level adjusters 40-*j* (j=1~25) are a part for adjusting the levels of the amplitudes of the individual band masking signals $x_j(t)$ according to the sound energies calculated by the energy calculator 32 and outputting the individual band masking signals having the adjusted amplitude levels. Details of the procedure performed by the level adjusters 40-*j* (j=1~25) are described below with reference to FIG. 3.

Each of the level adjusters 40-*j* (j=1~25) writes samples of the corresponding band masking signal $z'_j(t)$ output from the band divider 39 to a corresponding storage region AR-$z'_j$ of the RAM 21. When writing of a sequence of samples of the band masking signal $z'_j(t)$ corresponding to the time T to the storage region AR-$z'_j$ is terminated, the level adjuster 40-*j* determines that the square of the amplitude of the band masking signal $z'_j(t)$ represented by the sample sequence is a sound energy thereof and then writes a sample sequence of a signal $ER_j(t)$ representing the sound energy to a storage region AR-$ER_j$ of the RAM 21. The level adjuster 40-*j* then obtains an average $ER_jAVE$ of energy corresponding to the time T represented by the sample sequence of the signal $ER_j(t)$ written to the storage region AR-$ER_j$ and an average $ES_jAVE$ of energy corresponding to the time T represented by the sample sequence of the signal $ES_j(t)$ which the energy calculator 32 writes to the storage region AR-$ES_j$, and determines that a value obtained by dividing the average $ER_jAVE$ by the average $ES_jAVE$ is a gain $g_j$. The level adjuster 40-*j* then sequentially reads the sample sequences written to the storage region AR-z' and outputs, as an adjusted band masking signal $M_j(t)$, a signal obtained by multiplying a band masking signal $z'_j(t)$ represented by the read sample sequence by the gain $g_j$.

As shown in FIG. 1, the adder 41 adds the output signals $M_j(t)$ (j=1~25) of the level adjusters 40-*j* (j=1~25) and outputs the result of the addition as a final masking sound signal M(t). A sample sequence of the masking sound signal M(t) output from the adder 41 is written to the buffer 17. When the sample sequence of the masking sound signal M(t) corresponding to the time T has been written to the buffer 17, the sound generating controller 18 repeats a process for reading the sample sequence from the buffer 17 and outputting the read sample sequence to the D/A converter 14.

The setting unit 50 receives an input operation for specifying values of the thresholds Th1 and Th2 and sets the specified thresholds Th1 and Th2 in the signal converters 35-*j* (j=1~25) according to the input operation. Here, the number of frames $F_{rl}$ (l=1, 2 . . . ) that are subject to change of the order of arrangement in signal converters 35-*j* increases as the difference between the thresholds Th1 and Th2 that the setting unit 50 has set in the signal converters 35-*j* (j=1~25) increases, and the number of frames $F_{rl}$ (l=1, 2 . . . ) that are subject to change of the order of arrangement in the signal converter 35-*j* decreases as the difference between the thresholds Th1 and Th2 decreases.

Details of the configuration of the masking sound generating apparatus 10 have been described above. As described above, the masking sound generating apparatus 10 segments each of the envelope signals $x''_j(t)$ (j=1~25) representing the respective envelopes of the bands of the target sound signal x(t) received from the room 91 into frames $F_i$ (i=1, 2 . . . ), and divides the frames $F_i$ (i=1, 2 . . . ) into frames $F_{sm}$ (m=1, 2 . . . ) in which the amplitude of the signal x"j(t) is less than or equal to the threshold Th1 or is equal to or greater than the threshold Th2 and frames $F_{rl}$ (l=1, 2 . . . ) in which the amplitude of the signal x"j(t) is greater than the threshold Th1 and less than the threshold Th2. The masking sound generating apparatus 10 then multiplies each envelope signal $y_j(t)$ (j=1~25), which is obtained by randomly changing the order of arrangement of the frames $F_{rl}$ (l=1, 2 . . . ) among the frames $F_i$ (i=1, 2 . . . ) of each of the respective envelope signals $x''_j(t)$ (j=1~25) of the bands, by a corresponding noise signal $C_j(t)$ (j=1~25) and outputs a masking sound signal M(t) generated based on the result of the multiplication to the room 92. Accordingly, by optimizing the setting of the thresholds Th1 and Th2 through input operation of the setting unit 50, it is possible to generate a masking sound that does not cause perception of noisy or unnatural sound.

In addition, the energy calculator 32 of the masking sound generating apparatus 10 generates signals $ES_j(t)$ (j=1~25) representing respective sound energies from the output signals $x_j(t)$ (j=1~25) of the band divider 31. The level adjusters 40-*j* (j=1~25) generate signals $ER_j(t)$ (j=1~25) representing respective sound energies from individual band masking signals $z'_j(t)$ (j=1~25) that are output from the band divider 39 after the order of arrangement of the frames is changed and determines that values obtained by dividing average energies $ER_jAVE$ (j=1~25) represented by the signals $ER_j(t)$ (j=1~25) by average energies $ES_jAVE$ (j=1~25) represented by the signals $ES_j(t)$ (j=1~25) are gains $g_j$ (j=1~25) and outputs a signal, obtained by multiplying the band masking signals $z'_j(t)$ (j=1~25) by the gains g (j=1~25), as adjusted band masking signals $M_j(t)$ (j=1~25). Accordingly, it is possible to generate, from the output signals $x_j(t)$ (j=1~25) of the band divider 31, band masking signals $M_j(t)$ (j=1~25) having spectral structures close to the output signals $x_j(t)$ (j=1~25).

Although the invention has been described above with reference to one embodiment, other embodiments are also possible according to the invention. The following are examples.

(1) In the above embodiment, the adder 38 adds the individual band masking signals $z_j(t)$ (j=1~25) of a plurality of (for example twenty five) bands output from the multipliers 37-*j* (j=1~25), the band divider 39 divides the output signal z(t) of the adder 38 into signals $z'_j(t)$ (j=1~25), the level adjusters 40-*j* (j=1~25) adjust the levels of the output signals $z'_j(t)$ (j=1~25) of the band divider 39, and the adder 41 again adds the level-adjusted signals and outputs the result of the addition as a final masking sound signal M(t) to the room 92. However, the output signals $z_j(t)$ (j=1~25) of the signal converters 35-*j* (j=1~25) may be directly input to the level adjusters 40-*j* (j=1~25), and the signals having levels adjusted by the level adjusters 40-*j* (j=1~25) may be added, and the result of the addition may then be output as a final masking sound signal M(t) to the room 92.

(2) In the above embodiment, each of the band dividers 31 and 39 divides an input signal into twenty five number of bands by ¼ octave interval. However, the input signal may be divided into bands narrower than ¼ octave and may also be divided into bands wider than ¼ octave. The number of bands into which the input signal is divided may also be greater or less than twenty five.

(3) In the above embodiment, each of the signal converters 35-*j* (j=1~25) segments the sample sequence of the corresponding envelope signal $x''_j(t)$ into frames $F_i$ (j=1~25), and the adders 37-*j* (j=1~25) uses the average of the amplitude of the signal $x''_j(t)$ of each frame $F_i$ as a representative value of the signal $x''_j(t)$ in the frame $F_i$. However, the minimum or maximum of the amplitude of the signal $x''_j(t)$ of each frame $F_i$ may also be used as a representative value of the signal $x''_j(t)$ in the frame $F_i$.

(4) In the above embodiment, the signal converters 35-*j* (j=1~25) change the order of arrangement of the frames in the envelope signals $x''_j(t)$ (j=1~25) using pseudo-random numbers generated from individual seed values of the signal converters 35-*j* (j=1~25). However, the signal converters 35-*j* (j=1~25) may also change the order of arrangement of frames using a common pseudo-random number. According to this embodiment, it is possible to reduce the amount of calculation required to change the order of arrangement of frames and also to reduce the time required to generate a masking sound signal M(t) from a target sound signal x(t).

(5) In the embodiments described above, the signal converters 35-*j* (j=1~25) perform randomization by changing the order of sections of the envelope signals $x''_j(t)$ (j=1~25) which belong to a range greater than the lower threshold Th1 and less than the upper threshold Th2. However, the manner or mode of the randomization is not limited to the above embodiments. For example, the randomization of the envelope signal can be performed by superimposing a noise sound to sections of each envelope signal $x''_j(t)$ (j=1~25) which fall in a range between the thresholds Th1 and Th2. Here, the superimposition of the noise sound may be performed by adding the noise sound to the sections of each envelope signal between the thresholds Th1 and Th2. Otherwise, the superimposition of the noise sound may be performed by modifying, with the noise sound, the sections of each envelope signal between the thresholds Th1 and Th2. In the embodiment described before, each of the signal converters 35-*j* (j=1~25) start the change of order of the sample sequence only after each LPF 34-*j* finishes the output of the sample sequence of the envelope signal $x''_j(t)$ having the time length T. On the other hand in this embodiment, each of the signal converters 35-*j* (j=1~25) can quickly start superimposition of the noise sound to the envelope signal $x''_j(t)$ immediately after each LPF 34-*j* starts the output of the sample sequence of the envelope signal $x''_j(t)$. Consequently, this embodiment can improve the real time performance of the generation of the masking sound signal.

(6) In the embodiments described before, common thresholds Th1 and Th2 are set commonly to the plurality of the frequency bands. Alternatively, the setting part may set the thresholds Th1 and Th2 individually or differently to respective one of the frequency bands. In a practical form, a storage medium is provided for previously storing a group of pairs of thresholds Th1 and Th2 for the respective frequency bands. When the masking sound generating apparatus is commenced, the group of the pairs of thresholds Th1 and Th2 is read out from the storage medium and applied to the plurality of the signal converters 35-*j* (j=1~25). In a more sophisticated form, a storage medium is provided for previously storing multiple of groups of thresholds Th1 and Th2, each group being optimized to a different property of the target sound signal. For example, one group of the thresholds Th1 and Th2 is optimized to a target sound signal of a male voice, and another group of the thresholds Th1 and Th2 is optimized to a target sound signal of a female voice. When the masking sound generating apparatus is commenced, an appropriate group of the thresholds Th1 and Th2 is selected from the storage medium according to the property of the target sound signal, and applied to the plurality of the signal converters 35-*j* (j=1~25).

(7) In the masking system of the embodiment described before, the target sound signal to be masked is utilized as a source of the masking sound signal. However, the source of the masking sound signal may be any sound different from the target sound signal. For example, voices of various types of persons are collected provisionally to prepare an audio signal. A storage medium such as a hard disk drive or removable IC memory is provided for storing the prepared audio signal. A reading part reads out the audio signal from the storage medium and provides the audio signal to the masking sound generating apparatus 10 as a source of the masking sound signal. In such a case, in the system shown in FIG. 1 the buffer 15 functions as the storage medium storing the audio signal and the sound receiving controller 16 functions as the reading part for reading out the audio signal from the storage medium.

(8) In the embodiments described before, the masking sound generating apparatus 10 generates the masking sound signal in real time basis. However, the invention is not limited to such a real time mode. For example, the masking sound signal generated by the masking sound generating apparatus 10 shown in FIG. 1 is previously stored in a storage medium such as a hard disk drive or removable IC memory. When the masking is required, the masking sound signal stored in the storage medium is read out by a reading part, and fed to the speaker 94. In such a case, in the system shown in FIG. 1 the buffer 17 functions as the storage medium storing the masking sound signal and the sound generating controller 18 functions as the reading part for reading out the masking sound signal.

The invention claimed is:

1. A masking sound generating apparatus comprising: one or more processors configured to function as a band dividing part divides an audio signal into a plurality of frequency bands, and generates a plurality of band signals belonging respectively to the plurality of the frequency bands;

an envelope signal generating part that generates a plurality of envelope signals representing respective envelopes of the plurality of the band signals generated by the band dividing part;

a signal converting part that applies to each of the plurality of the envelope signals generated by the envelope signal generating part a signal conversion process so as to randomize sections of the envelope signal which are greater than a first threshold and less than a second threshold which is greater than the first threshold, and outputs the plurality of the envelope signals each applied with the signal conversion process;

a multiplying part that multiplies each envelope signal outputted from the signal converting part by a signal belonging to a frequency band same as that of each envelope signal, and outputs the plurality of the envelope signals multiplied by the signals as individual band masking signals corresponding to the respective frequency bands; and an adding part that adds the individual band masking signals output by the multiplying part and outputs a masking sound signal as a result of the addition.

2. The masking sound generating apparatus according to claim 1, wherein the signal converting part performs the signal conversion process such that the signal converting part segments each of the plurality of the envelope signals generated by the envelope signal generating part into a plurality of sections arranged sequentially along a time axis, then specifies sections of the envelope signal which have an amplitude greater than the first threshold and less than the second threshold, and changes an order of the specified sections in an arrangement of the plurality of the sections.

3. The masking sound generating apparatus according to claim 1, wherein the signal converting part applies to each envelope signal the signal conversion process so as to randomize the envelope signal by superimposing a noise sound to the sections of the envelope signal which are greater than the first threshold and less than the second threshold.

4. The masking sound generating apparatus according to claim 1, further comprising a setting part that sets the first threshold and the second threshold commonly to the plurality of the frequency bands.

5. The masking sound generating apparatus according to claim 1, further comprising a setting part that sets the first threshold and the second threshold individually to respective one of the plurality of the frequency bands.

6. The masking sound generating apparatus according to claim 1, further comprising an adjusting part that adjusts amplitudes of the individual band masking signals according to respective average energies of the plurality of the band signals generated by the band dividing part.

7. A masking system comprising:

a microphone that collects a sound and inputs an audio signal representing the collected sound;

a band dividing part that receives the audio signal provided from the microphone, then divides the audio signal into a plurality of frequency bands, and generates a plurality of band signals belonging respectively to the plurality of the frequency bands;

an envelope signal generating part that generates a plurality of envelope signals representing respective envelopes of the plurality of the band signals generated by the band dividing part;

a signal converting part that applies to each of the plurality of the envelope signals generated by the envelope signal generating part a signal conversion process so as to randomize sections of the envelope signal which are greater than a first threshold and less than a second threshold which is greater than the first threshold, and outputs the plurality of the envelope signals each applied with the signal conversion process;

a multiplying part that multiplies each envelope signal outputted from the signal converting part by a signal belonging to a frequency band same as that of each envelope signal, and outputs the plurality of the envelope signals multiplied by the signals as individual band masking signals corresponding to the respective frequency bands;

an adding part that adds the individual band masking signals output by the multiplying part and outputs a masking sound signal as a result of the addition; and a speaker that outputs a sound according to the masking sound signal output from the adding part.

8. A masking system comprising:

a non-transitory recording medium that records an audio signal;

a reading part that reads out the audio signal from the recording medium;

a band dividing part that receives the audio signal provided from the reading part, then divides the audio signal into a plurality of frequency bands, and generates a plurality of band signals belonging respectively to the plurality of the frequency bands;

an envelope signal generating part that generates a plurality of envelope signals representing respective envelopes of the plurality of the band signals generated by the band dividing part;

a signal converting part that applies to each of the plurality of the envelope signals generated by the envelope signal generating part a signal conversion process so as to randomize sections of the envelope signal which are greater than a first threshold and less than a second threshold which is greater than the first threshold, and outputs the plurality of the envelope signals each applied with the signal conversion process;

a multiplying part that multiplies each envelope signal outputted from the signal converting part by a signal belonging to a frequency band same as that of each envelope signal, and outputs the plurality of the envelope signals multiplied by the signals as individual band masking signals corresponding to the respective frequency bands;

an adding part that adds the individual band masking signals output by the multiplying part and outputs a masking sound signal as a result of the addition; and a speaker that outputs a sound according to the masking sound signal output from the adding part.

9. A masking sound generating method comprising:

a band dividing process of dividing an audio signal into a plurality of frequency bands, and generating a plurality of band signals belonging respectively to the plurality of the frequency bands;

an envelope signal generating process of generating a plurality of envelope signals representing respective envelopes of the plurality of the band signals generated by the band dividing process;

a signal converting process of applying to each of the plurality of the envelope signals generated by the envelope signal generating process a signal conversion so as to randomize sections of the envelope signal which are greater than a first threshold and less than a second threshold which is greater than the first threshold, and outputting the plurality of the envelope signals each applied with the signal conversion;

a multiplying process of multiplying each of the plurality of the envelope signals applied with the signal conversion by a noise signal, and outputting the plurality of the envelope signals multiplied by the noise signal as individual band masking signals corresponding to the respective frequency bands; and an adding process of adding the individual band masking signals output by the multiplying process, and outputting a masking sound signal as a result of the addition.

10. A non-transitory machine readable medium for use in a computer, containing program instructions executable by the computer to perform:

a band dividing process of dividing an audio signal into a plurality of frequency bands, and generating a plurality of band signals belonging respectively to the plurality of the frequency bands;

an envelope signal generating process of generating a plurality of envelope signals representing respective envelopes of the plurality of the band signals generated by the band dividing process;

a signal converting process of applying to each of the plurality of the envelope signals generated by the envelope signal generating process a signal conversion so as to randomize sections of the envelope signal which are greater than a first threshold and less than a second threshold which is greater than the first threshold, and outputting the plurality of the envelope signals each applied with the signal conversion;

a multiplying process of multiplying each of the plurality of the envelope signals applied with the signal conversion by a signal belonging to a frequency band same as that of each envelope signal, and outputting the plurality of the envelope signals multiplied by the noise signal as individual band masking signals corresponding to the respective frequency bands; and an adding process of adding the individual band masking signals output by the multiplying process, and outputting a masking sound signal as a result of the addition.

* * * * *